US006968977B1

(12) United States Patent
Beene

(10) Patent No.: US 6,968,977 B1
(45) Date of Patent: Nov. 29, 2005

(54) APPARATUS TO DISPENSE TOOTHPASTE

(76) Inventor: Jerahmy J. Beene, 8327 Gardenia Cir., Pensacola, FL (US) 32534

( * ) Notice: Subject to any disclaimer, the term of this patent is extended or adjusted under 35 U.S.C. 154(b) by 0 days.

(21) Appl. No.: 11/074,210

(22) Filed: Mar. 8, 2005

(51) Int. Cl.[7] ..... B65D 35/28
(52) U.S. Cl. ..... 222/101; 222/96; 222/105
(58) Field of Search ..... 222/96, 101, 102, 222/105

(56) References Cited

U.S. PATENT DOCUMENTS

| | | | | |
|---|---|---|---|---|
| 4,019,655 | A * | 4/1977 | Moeller | 222/96 |
| 4,258,864 | A | 3/1981 | Karamanolis | |
| 5,195,659 | A | 3/1993 | Eiskant | |
| 5,199,610 | A * | 4/1993 | Gagliardi | 222/101 |
| 5,447,255 | A * | 9/1995 | Smedley | 222/102 |
| D368,612 | S | 4/1996 | Amin | |
| 5,573,138 | A * | 11/1996 | Lin | 222/96 |
| 5,845,813 | A | 12/1998 | Werner | |
| 6,318,596 | B1 * | 11/2001 | Wiesner | 222/1 |
| 6,378,732 | B1 * | 4/2002 | Park | 222/102 |
| 6,401,978 | B1 | 6/2002 | Young | |
| 6,454,133 | B1 * | 9/2002 | Lopez et al. | 222/102 |
| 2003/0164383 | A1 | 9/2003 | Pierre-Louis | |

FOREIGN PATENT DOCUMENTS

| | | | | |
|---|---|---|---|---|
| WO | WO 9419252 A1 * | 9/1994 | ..... | B65D 35/28 |

* cited by examiner

*Primary Examiner*—Kenneth Bomberg

(57) ABSTRACT

A device to dispense and contain a tube of toothpaste. The device has two portions, an outlet compartment and a slide bar compartment. The outlet compartment contains a toothpaste dispensing outlet hole, a slide release button, and a dispense button. The slide bar compartment has a pull grip ridge on a side of the slide bar compartment. A top cover of the slide bar compartment is released by depressing the slide release button, a slide bar base is exposed within a cavity of the slide bar compartment to hold a toothpaste tube.

1 Claim, 5 Drawing Sheets

APPARATUS TO DISPENSE TOOTHPASTE

The present disclosure pertains to an apparatus used for containing and automatically dispensing toothpaste from a tube.

Description of Related Art

The need to contain and dispense toothpaste from a collapsible tube conveniently is well known in the art. Various dispensers have been proposed.

For example, the following patents U.S. 2003/0164383 and 5,195,659, describe apparatuses which dispense toothpaste using a spring as their driving mechanism and a plunger. When the plunger is pushed downward a specific amount of toothpaste is dispensed because rollers are moving down the tube squeezing the paste out. One patent allows for the storage of two toothbrushes on the housing. The subsequent patent is meant to be wall mounted in the bathroom and comes with interchangeable tube caps for the various sizes of toothpaste tubes available for purchase.

Further patents, U.S. Pat. Nos. 6,401,978 B1, 5,845,813, and 4,258,864, utilize roller assemblies to expel the toothpaste from the tube. One patent is also wall-mountable. However, these patents are powered by electric motors requiring either batteries or an electrical outlet.

The preceding devices use similar techniques to aid in the dispensing of toothpaste from a tube. Each device somewhat differs as to its chosen method of expelling the toothpaste, subsequent complexity, and portability.

BRIEF DESCRIPTION OF THE FIGURES

The present invention is illustrated by way of example and not limited in the Figures of the accompanying drawings.

DETAILED DESCRIPTION

The following description provides for an apparatus to dispense toothpaste from a tube automatically. In the following description, numerous specific details are set forth in order to provide a more thorough understanding of the present invention. It will be appreciated, however, by one skilled in the art that the invention may be practiced without such specific details. Those of ordinary skill in the art, with the included descriptions, will be able to implement the apparatus that contains and automatically dispenses toothpaste from a tube.

As previously described, various versions exist for aiding in the containment and dispensing of toothpaste. For example, some are driven by electric motors while some utilize mechanistic means of squeezing the tube to expel the paste. Also, some previous devices also require a mounting to a permanent wall structure. In contrast, the claimed subject matter depicts a device that can house a single tube of toothpaste operated by a simple spring loaded rod that forces the roller over a tube and is entirely portable. This makes it easy to store in drawers to save counter space/wall space in bathrooms and makes it convenient for traveling. Likewise, the simple design and construction make the device easy to use for all ages and variations on physical strength while eliminating the annoying process of folding a tube of toothpaste to extract the product.

Figure 1:
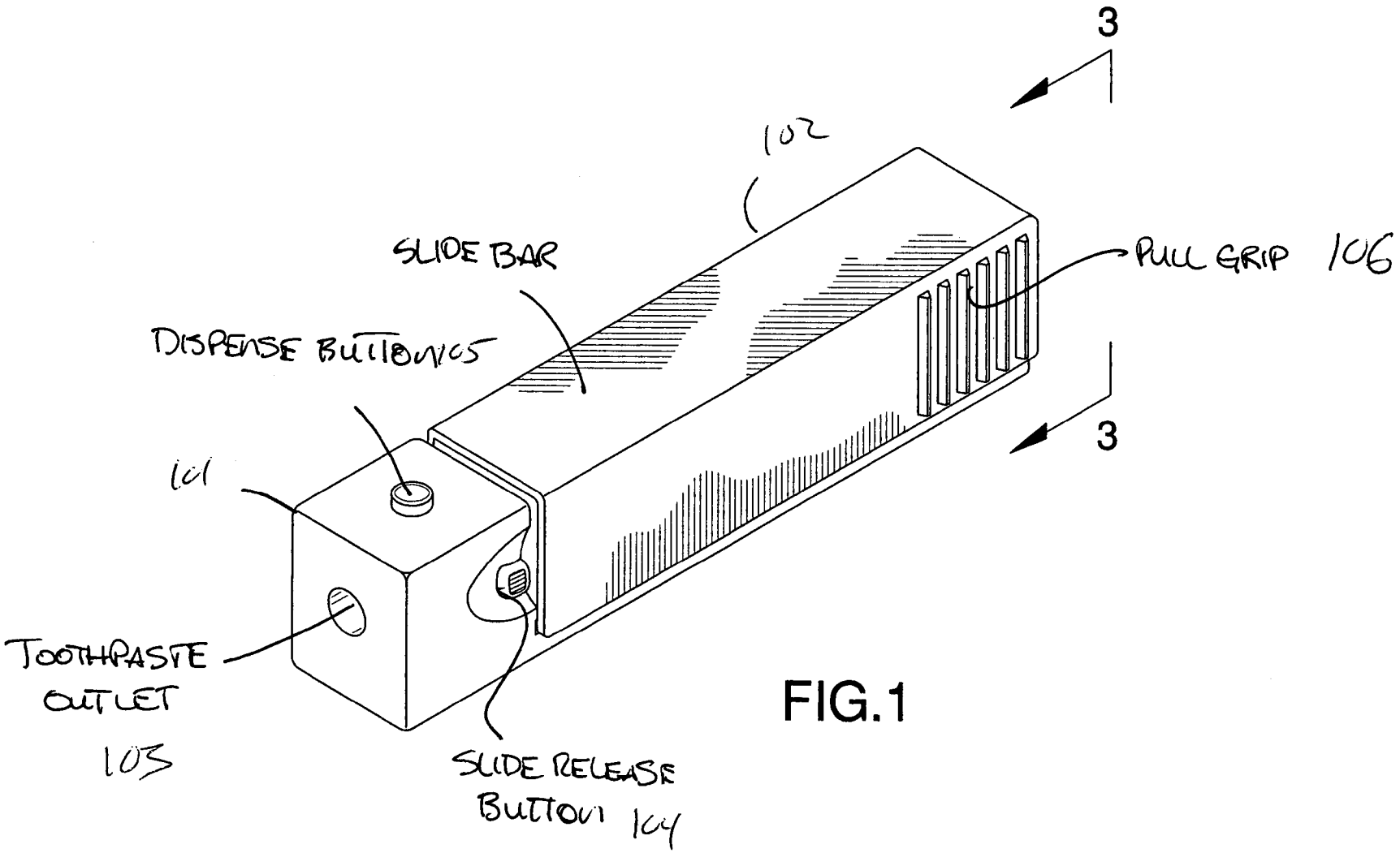
FIG. 1 illustrates an apparatus when viewed from the side with a hole from which to expel the toothpaste, a dispenser button, and the main body.

FIG. 1 illustrates an apparatus featuring two portions an outlet compartment 101 and a slide bar compartment 102. The outlet compartment 101 has a toothpaste dispensing outlet hole 103, a slide release button 104 and a dispense button 105. The slide bar compartment has a pull grip ridge 106 on a side of the slide bar compartment. A top cover of the slide bar compartment is released by depressing the slide release button, a slide bar base is exposed within a cavity of the slide bar compartment to hold a toothpaste tube.

Figure 2:
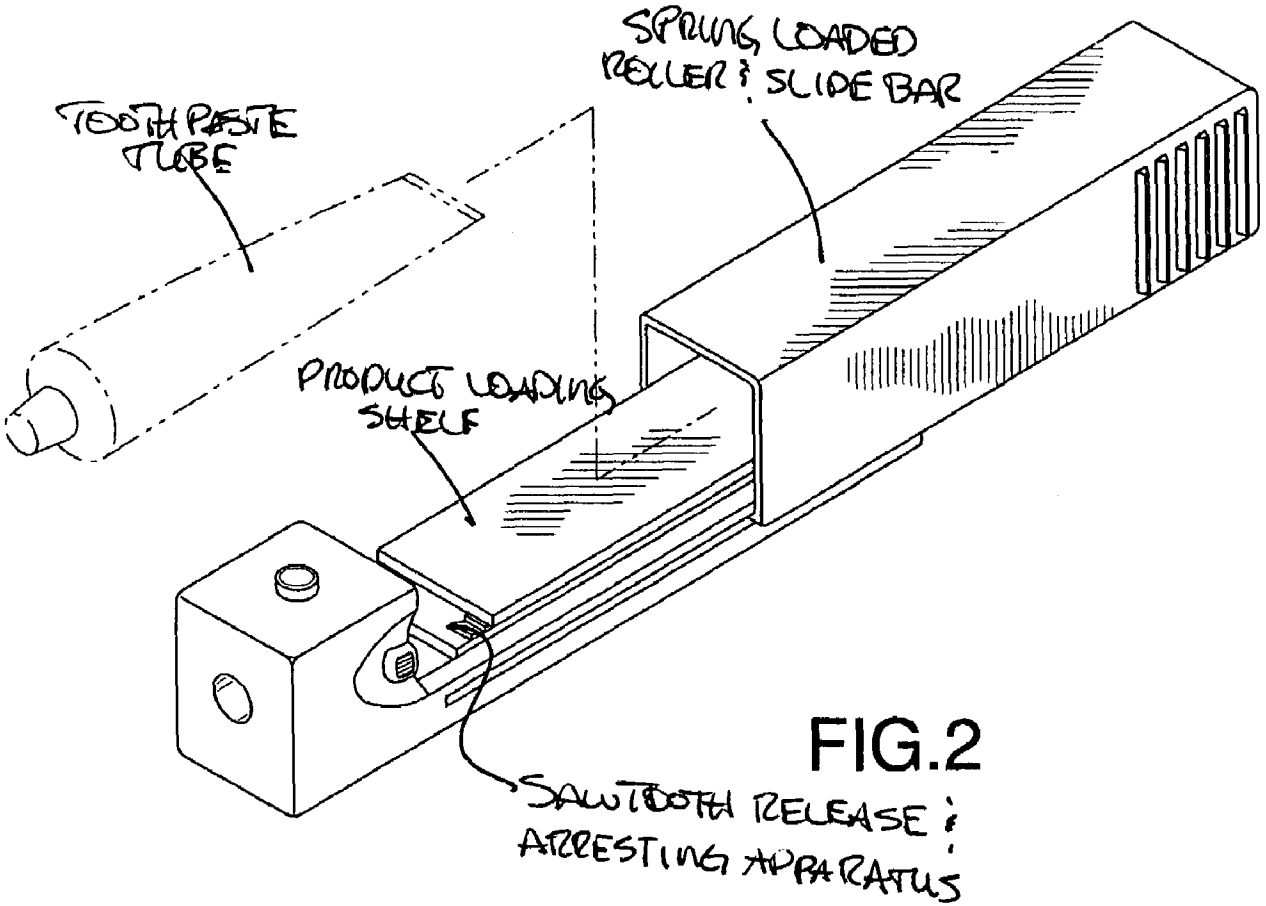
FIG. 2 illustrates an internal view of the embodiment depicted in FIG. 1 when slid open to accommodate the installation of a tube of a pictured tube of toothpaste.
Figure 3:
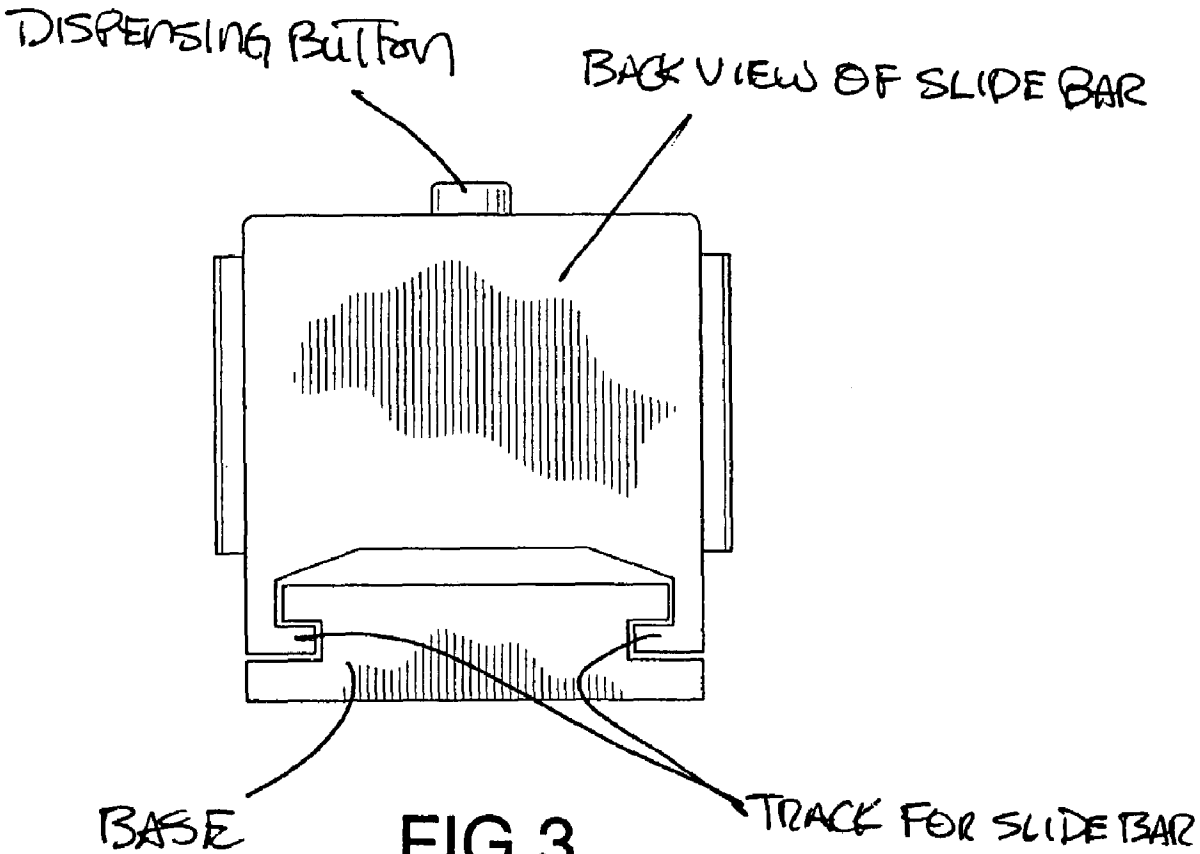
FIG. 3 illustrates a back-view of the main body.
Figure 4:
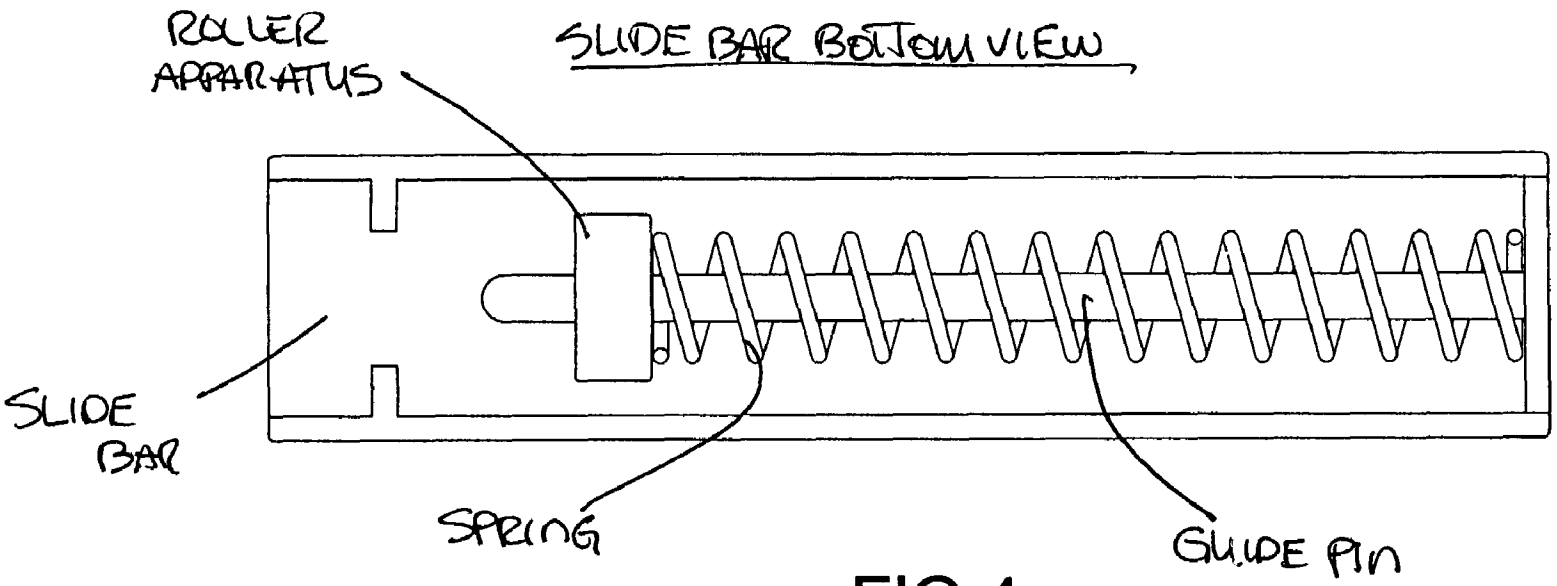
FIG. 4 illustrates an internal view of the slide bar bottom that houses a spring device, roller apparatus, and glide pin.

The dispensing portion connects to the body portion, but is not able to move like the body portion. In this embodiment, the body consists of a slide bar that can be pulled back to allow loading of the toothpaste product. This sliding process is made easier by the six raised vertical extensions on the back end of the slide bar to add a gripping surface. The toothpaste is dispensed through a hole at the front of the dispensing head by pressing the dispensing button located on top of the square dispensing head. The slide bar is released by a pushing a button located on the left side of the dispensing head. This allows the slide bar to be pulled back away from the dispensing head revealing a product shelf inside the apparatus where the tube is positioned horizontally (FIGS. 2 and 3). The slide bar runs along an inner track and the pulling back of the slide bar is what simultaneously cocks the spring device inside. FIG. 4 illustrates the slide bar from a bottom perspective. The mechanism consists of a glide pin that the spring encircles with the roller apparatus at one end. When the slide bar is pulled back the roller apparatus is forced back compressing the spring.

Figure 5:
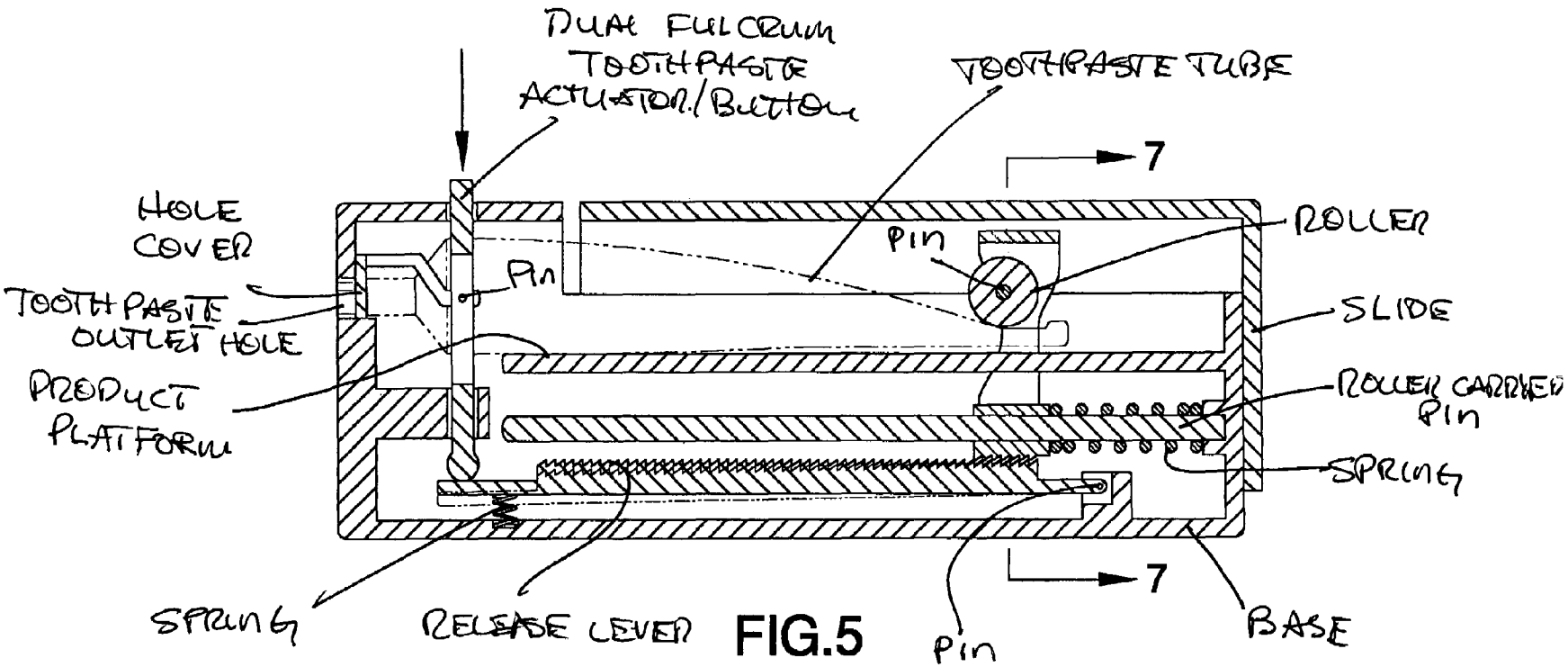
FIG. 5 illustrates a detailed internal side view of the entire main body of the apparatus showing a tube of toothpaste resting on a product platform in relation to the roller apparatus and spring mechanism.

FIG. 5 illustrates a detailed internal view of the embodiment depicted in FIG. 1. In one aspect and embodiment, the apparatus depicts a toothpaste tube resting on the product platform with the head of the tube located at the toothpaste outlet hole.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure.

What is claimed is:

1. An apparatus for a toothpaste dispenser comprising:

an outlet compartment with a toothpaste dispensing outlet hole and slide release button and a dispense button;

a slide bar compartment with a pull grip ridge on a side of the slide bar compartment, a top cover of the slide bar compartment to be released by depressing the slide release button, a slide bar base within a cavity of the slide bar compartment to hold a toothpaste tube;

a roller structure to push the slide bar forward via a guide pin and a spring to dispense toothpaste from the tube out of the toothpaste outlet hole.

* * * * *